US005291170A

United States Patent [19]

Wahba et al.

[11] Patent Number: 5,291,170

[45] Date of Patent: Mar. 1, 1994

[54] ELECTROMAGNETIC ACTUATOR WITH RESPONSE TIME CALIBRATION

[75] Inventors: Brent J. Wahba, Honeoye Falls, N.Y.; Paul B. Rissi, Grand Rapids, Mich.

[73] Assignee: General Motors Corporation, Detroit, Mich.

[21] Appl. No.: 956,190

[22] Filed: Oct. 5, 1992

[51] Int. Cl.[5] ..... H01F 7/10

[52] U.S. Cl. ..... 335/246

[58] Field of Search ..... 335/126, 131, 243, 244, 335/245, 246; 361/146, 154

[56] References Cited

U.S. PATENT DOCUMENTS

| | | | |
|---|---|---|---|
| 2,736,843 | 2/1956 | Douglas et al. | 335/245 |
| 2,883,976 | 4/1959 | Woodward et al. . | |
| 2,979,641 | 4/1961 | Gunthard et al. | 361/146 |
| 3,587,547 | 6/1971 | Hussey et al. . | |
| 3,665,899 | 5/1972 | Nagy . | |
| 3,942,485 | 3/1976 | Suda et al. . | |
| 4,154,198 | 5/1979 | Hoshi . | |
| 4,218,669 | 8/1980 | Hitchcock et al. . | |
| 4,225,898 | 9/1980 | Weber et al. . | |
| 4,234,903 | 11/1980 | Harper . | |
| 4,254,653 | 3/1981 | Casey et al. . | |
| 4,338,651 | 7/1982 | Henrich . | |
| 4,355,619 | 10/1982 | Wilkinson . | |
| 4,604,675 | 8/1986 | Pflederer . | |
| 4,830,333 | 5/1989 | Watson . | |
| 4,903,669 | 2/1990 | Groff et al. . | |
| 4,925,112 | 5/1990 | Wahba . | |
| 4,933,805 | 6/1990 | Calfus . | |
| 4,949,904 | 8/1990 | Bata et al. . | |

*Primary Examiner*—Lincoln Donovan
*Attorney, Agent, or Firm*—Mark A. Navarre

[57] ABSTRACT

An electromagnetic actuator having an integral calibration mechanism for easy adjustment of armature response times. An additional (secondary) coil is incorporated into the device for providing a magnetic field opposing the magnetic field produced by the actuator's primary coil. A variable resistive element, used in conjunction with the secondary coil, provides a means for adjusting the current flow through the secondary coil and thereby the strength of the resultant magnetic field experienced by the armature. Since an is armature's response is proportional to the strength of the magnetic field to which it is subjected, this invention provides a means of calibrating the armature response times of an actuator. The availability of establishing a uniform, desired response results in improved multiple actuator system functionality and more reliable actuator interchangeability.

6 Claims, 2 Drawing Sheets

ELECTROMAGNETIC ACTUATOR WITH RESPONSE TIME CALIBRATION

This invention relates to an electromagnetic actuator having an integral calibration for electrically adjusting the armature response times.

BACKGROUND OF THE INVENTION

Electromagnetic actuators contain one or more cylindrical coils of insulated wire called solenoids (hereinafter referred to as coils). Energization of a coil by a dc voltage source creates a steady current flow through the coil which produces an axial magnetic field. The direction of the magnetic field is dependent upon the direction in which the coil conductor is wound and the direction of the current flow through the coil.

Electromagnetic actuators also contain a movable ferromagnetic component called an armature. The armature is located within the magnetic field and is subjected to a force, created by the field, which is proportional to the strength of the field. This force causes the armature to move in the same direction as the magnetic field.

Deenergization of a coil (removing the dc voltage source) interrupts the current flow. As a result, the magnetic field collapses and the force dissipates. Typically, the armature is returned to its original position by means of a spring.

The time it takes an armature to complete its movement in the direction of the magnetic field upon energization of the coil, and the time it takes the armature to return to its original position upon deenergization of the coil, are hereinafter referred to as the armature response times.

Armature response times are affected by several factors, including the number of coil turns, the density of the coil windings (turns per meter), the intrinsic resistance of the coil conductor, the distance between the armature and the coil, the metallurgical composition of the armature, return spring forces and the internal clearances around movable elements. These factors, among others, will vary among identically constructed actuators as a result of manufacturing variations within allowable design tolerances and are significant enough to result in a range of response times. When required to work in concert with one another to exacting specifications (e.g., electromagnetic fuel injectors in a multiple cylinder internal combustion engine), or when replacing an actuator with one manufactured to the same "specification," the above-noted variations may become unacceptable.

One approach is to tighten the allowable tolerances. Unfortunately, the manufacture of any device is limited by the accuracy and consistency of the equipment used and their respective operators. Often, identical devices are produced by different manufacturers with different equipment. Even when produced by the same manufacturer, equipment functionality and operator performance will vary from day to day. Therefore, metallurgical and dimensional differences between actuators manufactured to identical specifications are inevitable, so allowable tolerances can be tightened only so much.

Another approach to the problem would be to provide an internal means of adjusting key components of the actuator itself (e.g., screw to adjust spring force, post-manufacture modification of core to adjust permeability, etc.). Such methods complicate the manufacturing process, inflate the actuator cost and necessitate a time-consuming calibration process typically requiring partial disassembly of the actuator, thereby subjecting it to contamination.

SUMMARY OF THE PRESENT INVENTION

The present invention is directed to an improved electromagnetic actuator having an internal calibration mechanism for easy adjustment of armature response times. The adjustment is achieved through the incorporation of an additional coil and a variable resistive element. The purpose of the additional (secondary) coil is to create a magnetic field opposing that produced by the actuator's primary coil. The variable resistive element provides a means for adjusting the current flow through the secondary coil. Adjustment of the resistive element, accessible from the exterior of the actuator, therefore provides a means of controlling the strength of the resultant magnetic field produced by the actuator. Since an armature's response is proportional to the strength of the magnetic field to which it is subjected, this invention provides a means of calibrating the armature's response.

According to one embodiment of this invention, as shown in FIG. 2, an electromotive force produced by the primary coil's magnetic field, immediately after energization and deenergization, induces the required current flow in the secondary coil to create the opposing magnetic field. According to alternative embodiments of this invention, shown in FIGS. 3 and 4, the secondary coil utilizes the same energization source as the primary coil to create the opposing magnetic field.

This invention permits calibration of individual actuators to exacting specifications despite variations within manufacturing tolerances. Uniform armature responses among multiple actuators would result in tighter overall system tolerances and more reliable interchangeability.

In the illustrated embodiments, the actuator of this invention is described in the context of a fuel injector for an internal combustion engine. The availability of a means for improving injector-to-injector response times, and therefore flow variation, enables more precise fuel delivery.

DETAILED DESCRIPTION OF THE PREFERRED EMBODIMENTS

Figure 1:
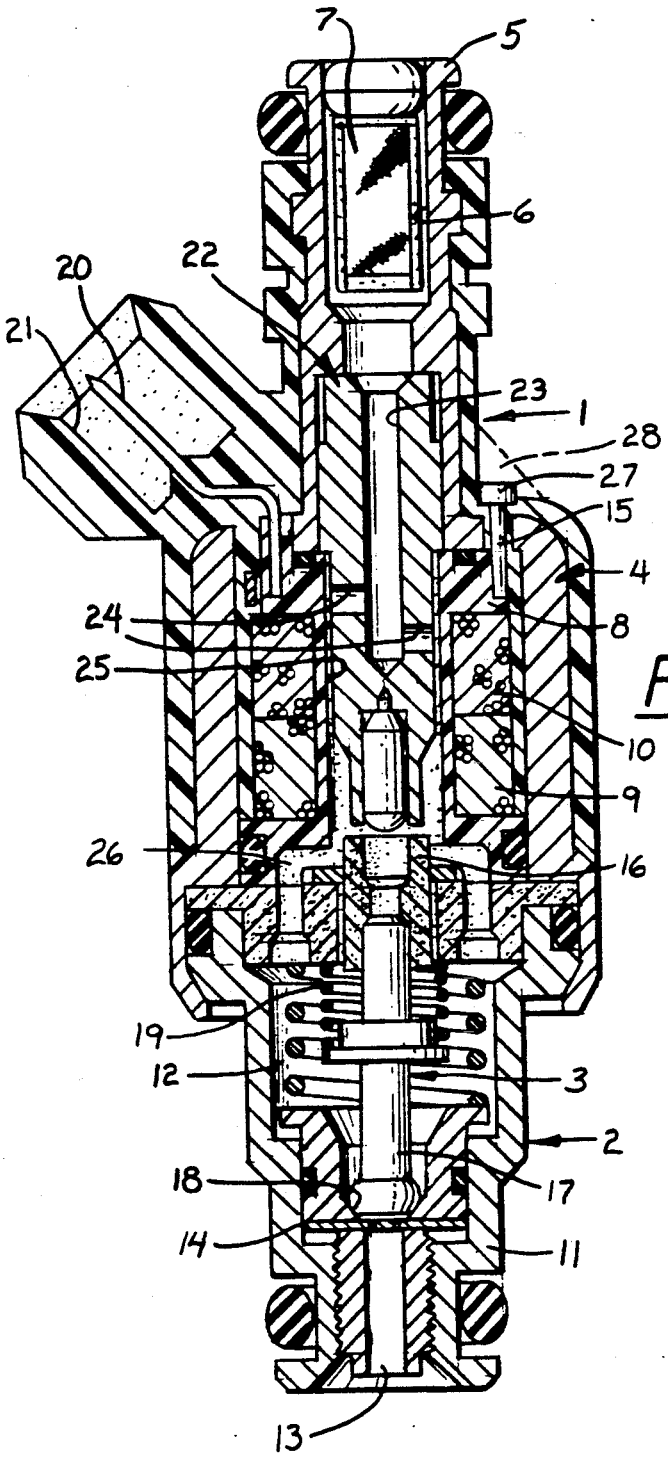
FIG. 1 is a longitudinal cross-sectional view of an electromagnetic fuel injector with a secondary coil and variable resistive element in accordance with the invention herein.

FIG. 1 illustrates a typical electromagnetic fuel injector for a gas-operated internal combustion engine, constructed in accordance with this invention. The injector includes, as major components thereof, an upper solenoid stator assembly 1 and a lower nozzle assembly 2 with an armature/valve 3 operatively positioned therein.

The solenoid stator assembly 1 includes a solenoid body 4 having an upper inlet tube portion 5. The inlet tube portion 5, comprised of an inlet fuel chamber 6 having a fuel filter 7 mounted therein, is adapted to be suitably connected to a source of low pressure fuel.

Figure 2:
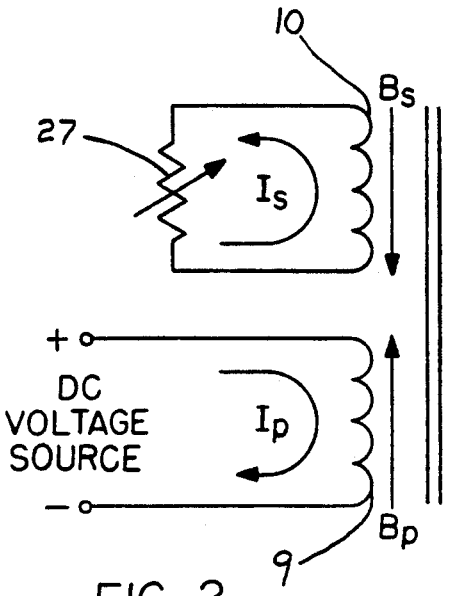
FIG. 2 illustrates an electrical circuit diagram of an electromagnetic fuel injector's primary coil, similarly wound secondary coil and variable resistive element configured to utilize the primary coil's time-varying magnetic field as the energization source for the secondary coil.
Figure 3:
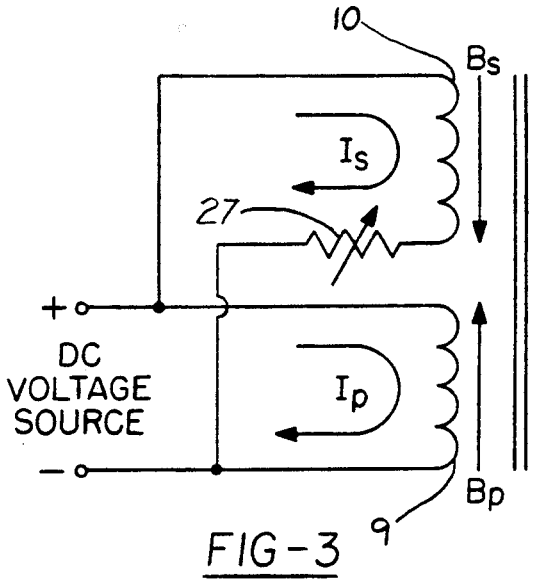
FIG. 3 illustrates an electrical circuit diagram of an electromagnetic fuel injector's primary coil, reverse wound secondary coil and variable resistive element configured to utilize the same energization source for both the primary and secondary coils.
Figure 4:
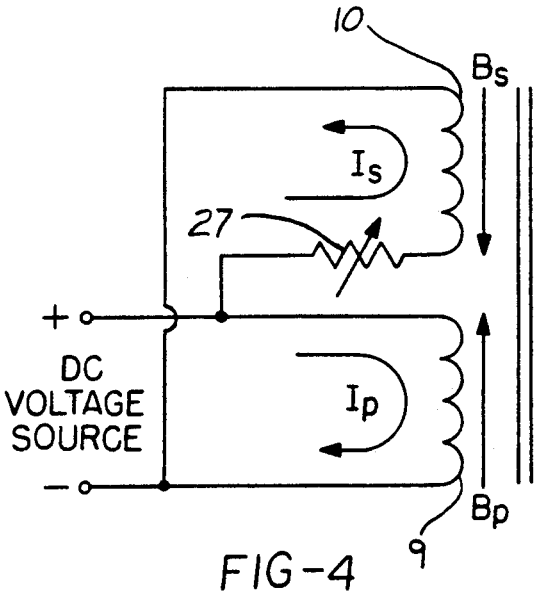
FIG. 4 illustrates an electrical circuit diagram of an electromagnetic fuel injector's primary coil, similarly wound secondary coil and variable resistive element configured to utilize the same energization source for both the primary and secondary coils.

The solenoid stator assembly 1 further includes a stationary pole piece 22, a spool-like tubular bobbin 8 about which are coaxially wound a primary solenoid coil 9 and secondary solenoid coil 10. A pair of connecting leads 15, only one being shown in FIG. 1, connect a laser trimmed variable resistor 27 which extends through the upper solenoid stator assembly 1 to the primary coil 9 and secondary coil 10 as shown in FIGS. 2, 3 and 4. Potting material 28 may be added after calibration to inhibit unauthorized readjustment. A pair of terminal leads 20, only one being shown in FIG. 1, are each operatively connected at one end to the solenoid coils 9 and 10 and variable resistor 27 as shown in FIGS. 2, 3 and 4. Each such lead has its other end extending up through a terminal socket 21 for connection to a suitable source of electrical power.

The nozzle assembly 2 includes a nozzle body 11 and a spring/fuel supply cavity 12. The nozzle assembly 2 further includes a tubular spray tip 13, an orifice director plate 14 and an armature/valve member 3. The armature/valve member 3 includes a tubular armature 16 and a valve element 17 having a lower end portion for engagement with the valve seat 18. The armature/-valve member 3 is normally biased in a seating engagement with the valve seat 18 by a valve return spring 19.

The solenoid stator pole piece 22 is provided with a blind bore defining an inlet passage portion 23 which at one end is in flow communication with the inlet fuel chamber 6. The other end of the inlet passage 23 is in flow communication via radial ports 24 with an annulus fuel cavity 25 formed by the diametrical clearance between the reduced diameter lower end of the pole piece 22 and the bobbin 8. The fuel cavity 25 is in flow communication, through an annular recessed cavity 26, with the spring/fuel cavity 12.

When the armature valve member 17 is electromagnetically biased in a non-seating engagement, fuel travels from the spring/fuel supply cavity 12 through the orifice plate 14 and out the tubular spray tip 13.

Referring to FIG. 1, the primary coil 9 is wound so as to produce, upon application of a dc voltage source to the terminal leads 20, a magnetic field which forces the armature 3 in a direction opposing the bias created by the valve return spring 19, thereby unseating the valve element 17 and permitting fuel to escape from the spring/fuel supply cavity 12 through the orifice plate 14 and out the tubular spray tip 13. The strength of the magnetic field and the force which it produces is proportional to the current flow through the primary coil 9.

FIG. 2 illustrates one embodiment of this invention. Both the primary coil 9 and secondary coil 10 are wound in the same direction. The variable resistor 27 forms a single-loop highly conductive closed circuit with the secondary coil 10. This electrical connection scheme utilizes the principle of electromotive force (emf), which exists only in the presence of time-varying magnetic fields, to achieve calibration of armature response times.

Prior to energization, there is no current flow Ip through the primary coil 9, and therefore no magnetic field Bp. At the moment of energization, both the current flow Ip through the primary coil 9 and the strength of the magnetic field Bp begin to increase (time-varying) until they reach their maximum values, at which point they remain constant until deenergization. The time-varying magnetic field Bp penetrates the secondary coil 10 and produces an electromotive force which induces a current Is around the single-loop closed circuit. The current Is flowing through the secondary coil 10 produces a magnetic field Bs which opposes the changing magnetic field Bp produced by the primary coil 9. As the magnetic field Bp produced by the primary coil 9 reaches its maximum value, the electromotive force in the secondary coil 10 dissipates and its magnetic field Bs collapses. Once the magnetic field Bp produced by the primary coil 9 reaches its maximum value (no longer time-varying), the secondary coil 10 is essentially non-functional and will no longer influence the operation of the injector. A similar effect is observed upon deenergization of the primary coil 9.

In short, when the primary coil 9 is initially energized, an increasing magnetic field Bp is produced. This increasing field Bp produces an electromotive force which induces an opposing magnetic field Bs in the secondary coil 10, whose strength is adjustable by means of a variable resistor 27 which controls the current flow Is through the secondary coil 10. Upon deenergization, the magnetic field BP produced by the primary coil 9 begins to decrease (collapse). This decrease produces an electromotive force which induces an opposing magnetic field Bs in the secondary coil 10, similarly adjustable by means of the variable resistor 27.

By utilizing a secondary coil 10 and variable resistor 27 to create an adjustable magnetic field Bs opposing the magnetic field Bp produced by the primary coil 9, the rate of increase and decrease of the magnetic field Bp produced by the primary coil 9, and thereby the strength of the force created by that magnetic field Bp as seen by the armature 3 during energization and deenergization, can be controllably dampened. Since response times are proportional to the strength of the force to which the armature 3 is subjected, calibration of armature response times is achieved.

FIG. 3 represents an alternative embodiment of this invention. Here, the secondary coil 10 utilizes the same source of energization as the primary coil 9. When configured as shown in FIG. 3, the reverse wound secondary coil 10 produces a magnetic field Bs which opposes the magnetic field Bp produced by the primary coil 9. Once again, the variable resistor 27 can be adjusted to control the flow of current Is through the secondary coil 10, varying the strength of the magnetic field Bs produced by the secondary coil 10 and thereby the resultant magnetic field (Bp - Bs) and its force upon the armature 3.

In contrast to the embodiment of FIG. 2, the magnetic field Bs produced by the secondary coil 10 as shown in FIG. 3 does not dissipate as the magnetic field Bp produced by the primary coil 9 reaches a maximum, constant value. Rather, it also reaches a maximum value and remains constant. The secondary coil 10 remains functional throughout the entire energization cycle of the injector, with its magnetic field Bs continuously opposing the magnetic field Bp produced by the primary coil 9. This achieves the added benefit of lowering the maximum field strength which must be reached during energization and collapsed during deenergization.

Yet another embodiment of this invention is shown in FIG. 4. In this connection scheme, the secondary coil 10 is wound in the same direction as the primary coil 9 and is connected to the same energization source, but with a polarity opposite that of the primary coil 9. Therefore, despite being wound in the same direction as the primary coil 9, the secondary coil 10 produces a magnetic field Bs which opposes the magnetic field Bp produced by the primary coil 9. The fields produced and their effects on the armature response times are identical as those detailed above for FIG. 3.

In the manner described above, calibration of armature response times for a fuel injector or any electromagnetic actuator can be achieved. This invention provides an inexpensive, efficient and reliable means of calibrating individual actuators, thereby achieving a desired, uniform response among multiple actuators.

While this invention has been described in reference to the illustrated embodiment, it will be understood that various modifications will occur to those skilled in the art, and that actuators incorporating such modifications may fall within the scope of this invention, which is defined by the appended claims.

The embodiments of this invention in which an exclusive property or privilege is claimed are defined as follows:

1. A calibratable direct current electromagnetic actuator, comprising:

a first coil, energized to produce a first magnetic field;

a second coil, energized to produce a second magnetic field directionally opposing said first magnetic field and lesser in magnitude than said first magnetic field, energization of said first and said second coils producing a resultant magnetic field with a magnitude equal to the difference between the magnitudes of said first and said second magnetic fields and directionally identical to said first magnetic field;

a variable resistance element, connected with said second coil, the resistance being adjustable to variably affect current flow through said second coil, thereby affecting the magnitude of said second and said resultant magnetic fields; and an armature electromagnetically biased to a first position by said resultant magnetic field in response to energization of said first and said second coils and mechanically biased to a second position in response to deenergization of said first and said second coils, the armature being moved from the second position to the first position in a first armature response time in response to said energization of said first and second coils and moved from the first position to the second position in a second armature response time in response to said deenergization of said first and second coils;

said variable resistance element having a value establishing the magnitude of the resultant magnetic field at a value whereby said first and said second armature response times are at predetermined values.

2. The actuator set forth in claim 1, wherein said second coil comprises a single-loop closed circuit with said variable resistance element.

3. The actuator set forth in claim 2, wherein a time-varying electromagnetic bias of said first coil produces an electromotive force which induces an opposing time-varying electromagnetic bias in said second coil.

4. The actuator set forth in claim 1, wherein said second coil, with said variable resistance element, is connected in parallel with said first coil and with a polarity so that said second magnetic field opposes said first magnetic field.

5. The actuator set forth in claim 4, wherein said first and second coils are wound in reverse directions and said second coil is connected to said first coil through said variable resistance element with said polarity of said second coil being the same as a polarity of said first coil.

6. The actuator set forth in claim 4, wherein said first and second coils are wound in the same direction and said second coil is connected to said first coil, through said variable resistance element, with said polarity of said second coil being reverse to a polarity of said first coil.

* * * * *